US005968212A

United States Patent [19]

Peise et al.

[11] Patent Number: 5,968,212

[45] Date of Patent: Oct. 19, 1999

[54] APPARATUS FOR GASIFICATION OF COMBUSTION AND WASTE MATERIALS CONTAINING CARBON AND ASH

[75] Inventors: Helmut Peise; Manfred Schingnitz; Dietmar Degenkolb, all of Freiberg, Germany

[73] Assignee: Noell-KRC Energie-und Umwelttechnik GmbH, Schkeuditz, Germany

[21] Appl. No.: 08/954,361

[22] Filed: Oct. 20, 1997

[30] Foreign Application Priority Data

Oct. 19, 1996 [DE] Germany ..... 196 43 258

[51] Int. Cl.[6] ..... F16H 21/40; C10J 1/28; C07C 1/00

[52] U.S. Cl. ..... 48/101; 48/74; 48/123; 48/197 R; 110/346; 585/240; 422/139

[58] Field of Search ..... 422/202, 139; 48/67, 74, 89, 94, 95, 99, 101, 123, 197 R; 585/240; 110/346

[56] References Cited

U.S. PATENT DOCUMENTS 4,188,915 2/1980 Kummel et al. ..... 122/6 A
4,343,626 8/1982 Peise et al. ..... 48/67
5,248,316 9/1993 Peise et al. ..... 48/76

FOREIGN PATENT DOCUMENTS 226 588 8/1985 Germany .
394 299 9/1931 United Kingdom .

*Primary Examiner*—Hien Tran
*Assistant Examiner*—James Kennedy
*Attorney, Agent, or Firm*—Cohen, Pontani, Lieberman & Pavane

[57] ABSTRACT

A device for utilizing combustion, residual and waste materials containing carbon and ash by gasification with an oxygen-containing oxidizing agent at temperatures above the melting point of the inorganic parts in a reaction chamber and at a pressure between ambient pressure and 60 bar. The reaction chamber contour is formed in part by a refractory-grade lining and in part by a cooling system comprising cooling coils connected in a gas-tight manner. The coils are coated with a thin layer of a ceramic mass that conducts heat well on a side facing the reaction chamber. The cooling coils are operated, while being cooled by pressurized water, below or above the boiling point of the cooling water.

7 Claims, 3 Drawing Sheets

APPARATUS FOR GASIFICATION OF COMBUSTION AND WASTE MATERIALS CONTAINING CARBON AND ASH

BACKGROUND OF THE INVENTION

1. Field of the Invention

The invention relates to a device for utilizing combustion and waste materials containing carbon and ash by means of gasification.

The device can be used wherever waste materials containing carbon and ash are gasified with oxygen or an oxidizing agent containing oxygen at increased or atmospheric pressure in a flame reaction at temperatures of at least 1100° C.

2. Description of the Related Art

Combustion materials containing ash include solid fuels with greater or lesser ash content, such as brown coal and hard coal and their cokes, as well as oil and tars slightly loaded with inorganic components and mixtures thereof with solids. Waste materials containing ash include solids and liquids found in the waste and recycling industry, in particular, such as communal and industrial sludges, used oils, oils containing PCBs, plastic and household waste fractions and their processing products, light shredder from the processing of auto, cable and electronic scrap, and contaminated aqueous solutions.

In gas production technology, the autothermal fluidized gasification of solid, liquid and gaseous combustion materials has been known for years. The ratio of combustion material to gasification agents containing oxygen is selected in such a way that, for reasons of synthesis gas quality, the higher carbon compounds are completely cracked into synthesis gas components such as CO and $H_2$, while the inorganic components are extracted as molten slag (see, i.e., J. Carl, P. Fritz, *Noell-Konversion-Verfahren,* EF Verlag fuer Energie- und Umwelttechnik GmbH, 1996, p. 39).

In various known systems the gasification gas and the molten slag can be extracted separately or jointly from the reaction chamber of the gasification device (see, i.e., F. J. Schweitzer, *Thermoselect-Verfahren,* EF Verlag fuer Energie- und Umwelttechnik GmbH 1994, p. 156).

German reference 4446803 A1 discloses that refractory-grade lined systems or cooled systems can be provided as the interior border for the reaction chambers of gasification systems.

Gasification systems equipped with refractory-grade linings have the advantage of lower heat losses, and thus provide energy-efficient conversion of the supplied combustion materials. However, such systems can be used only for ash-free combustion materials, because the molten slag that flows down the interior surface of the reaction chamber during the fluidized gasification process dissolves the refractory-grade lining. This means that only limited reactor runs are possible before costly relining becomes necessary.

To overcome this disadvantage, cooled systems based on the principle of a membrane wall have been created for combustion materials containing ash. The cooling initially causes a solid slag layer to form on the surface associated with the reaction chamber. The thickness of the solid slag layer increases until further slag ejected from the gasification area runs down this wall as a liquid and flows out of the reaction chamber, e.g., together with the gasification gas. Such systems are highly resistant and ensure long reactor runs. A substantial disadvantage of these systems, however, is that up to roughly 5% of the furnished energy is transferred to the cooled screen and is available only in the form of hot water or low-pressure steam. This can be a considerable disadvantage, especially in the case of low-caloric combustion materials and waste materials.

Various combustion and waste materials (e.g., oils containing heavy metals or light ash, tars and tar-oil-solid sludges) contain too little ash to form an adequate protective slag layer on the cooled reactor walls. This, too, leads to energy losses. On the other hand, in reactors with refractory-grade linings, the ash content of such materials is too high to avoid the melting or dissolution of the refractory-grade layer or to achieve sufficiently long reactor runs before re-lining is necessary.

SUMMARY OF THE INVENTION

Accordingly, the object of the invention is to provide a gasification apparatus that can use combustion and waste materials that have a wide variety of ash contents.

The device according to the invention is suitable not only for the gasification of combustion and waste materials with a wide variety of ash contents, but also for the combined gasification of gasses, liquids and solids containing hydrocarbons.

According to the invention, the contour of the reaction chamber for the gasification process, which can involve a fluidized reactor or a fixed bed reactor, is bordered in part by a refractory-grade lining and in part by a cooled screen.

The reactor should be suitable for pressures between ambient pressure and 60 bar, preferably between ambient pressure and 30 bar. The refractory-grade lining can encompass the cylindrical part of the reactor space or parts thereof as well as the floor of the reactor space. The part not consisting of refractory-grade material consists of an intensively cooled contour with a ceramic coating. The scope of the area to be cooled is based on the quantity of molten slag that accrues.

The cooled area is formed by single-plex or multi-plex wound coils, through which cooling water flows at high speed and at a pressure that exceeds the gasification pressure. The cooling coils can be operated, while being cooled by pressurized water, above or below the boiling point of the cooling water. The cooling coils are attached to the sides of the reaction chamber by studs and coated with a ceramic mass that conducts heat well. The good cooling allows molten slag to solidify on this mass, so that a slag cover develops on which slag that is still molten can flow down. As a result, the cooling coils are reliably protected, even against corrosive attacks.

Instead of a screen of pipes connected in a gas-tight fashion, a double-mantle design with a cooling space can be used. Furthermore, it is advantageous to design the cooling system so that the outlet opening and the floor can be cooled either in series with or parallel to the cylindrical mantle of the apparatus. The cooling system of the cylindrical reaction chamber contour can be expanded upward easily. It is also advantageous to design the joint between the refractory-grade material and the floor cooling system in an overlapping manner to compensate for different heat expansions. The inventive construction is advantageous in that it can allow for the different ash contents of combustion and waste materials.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numbers identify similar elements throughout the several views.

DETAILED DESCRIPTION OF THE PRESENTLY PREFERRED EMBODIMENTS

Figure 1:
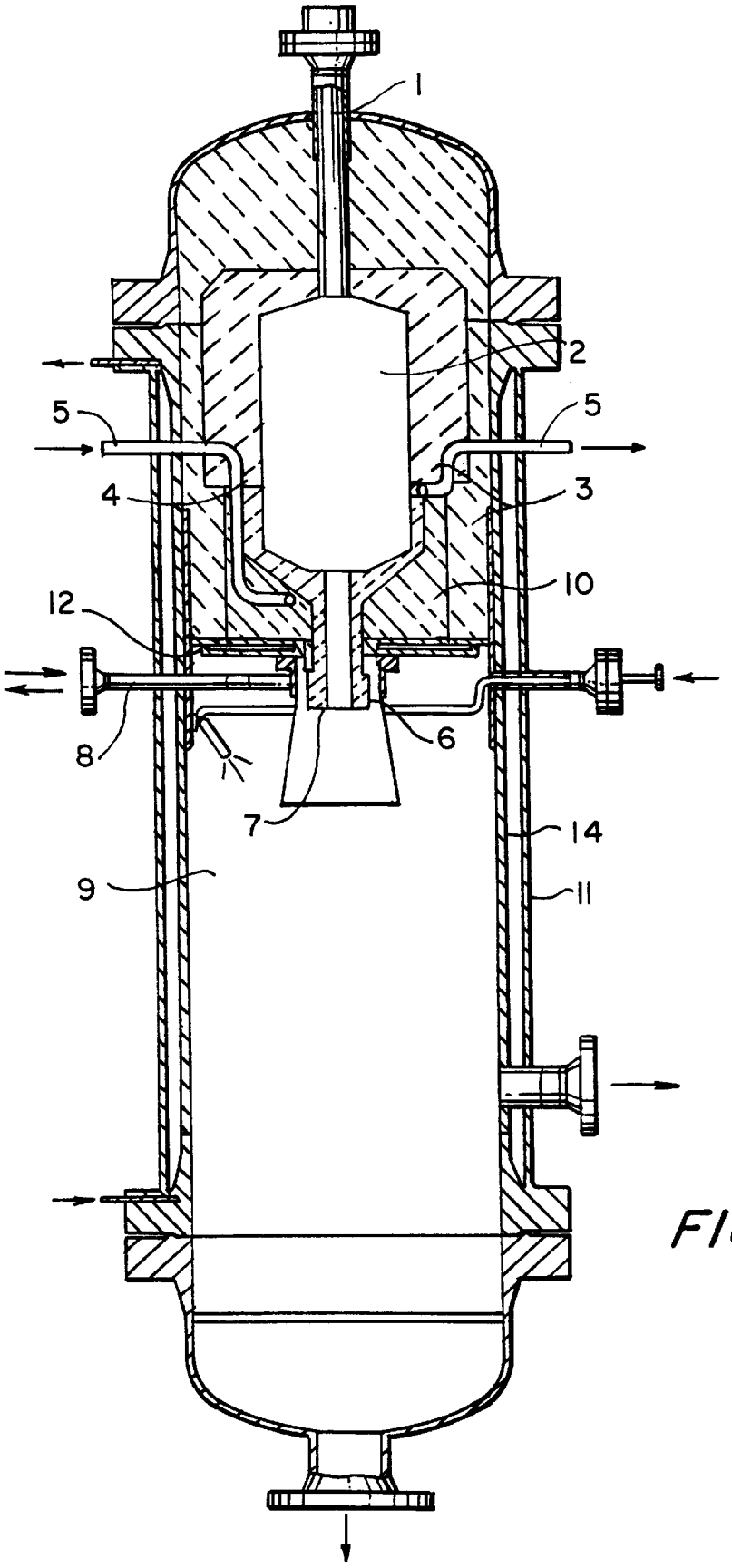
FIG. 1 is a schematic cross-section through an apparatus for the gasification of contaminated used oils slightly loaded with solids.

FIG. 1 shows an apparatus having a gasification reactor with a reaction chamber 2 that allows contaminated used oils slightly loaded with solids to be utilized in an environmentally friendly manner by the production of raw gasification gas at 26 bar and approximately 1500° C. In its upper part, the reactor has a refractory-grade lining 3. In the lower part of the reactor, the lining 3 passes over into a helically coiled pipe of a floor cooling system 4, whose windings are connected to each other by pieces welded in a gas-tight manner so as to form a wall. The floor cooling system 4 has a cylindrical part and a spherical part. A cooling water supply and extraction system 5 includes pipes arranged in the container mantle for supplying and extracting cooling water to and from the floor cooling system 4.

An outlet cooling means 6, which forms the discharge opening for raw gas and slag, is arranged centrally on the lower floor of the reactor. A slag drain edge 7 is located on the lower part of the outlet cooling means 6. In the illustrated embodiment, the water of the outlet cooling means 6 is supplied and extracted through the container mantle from the pressure chamber via pipe 8. In principle, it is also possible for water to flow through the floor cooling system 4 and the outlet cooling means 6 in a serial connection. A cooling and washing stage 9 is connected to the reactor in the downward direction.

Assembly spaces between the floor cooling system 4, the outlet cooling means 6 and the metallic pressure container of the reaction chamber 2 or the refractory-grade lining 3 are sealed with a ceramic fiber material 10. The cylindrical mantle 14 is surrounded by a cooling mantle 11, through which water flows. The gasification media enter the reaction chamber 2 via a burner unit 1 and are converted in a flame reaction. The flame is ignited on the heated refractory-grade lining 3. The refractory-grade lining 3 and the floor cooling system 4 of helically coiled pipe are supported on a cooled carrier plate 12.

Figure 2:
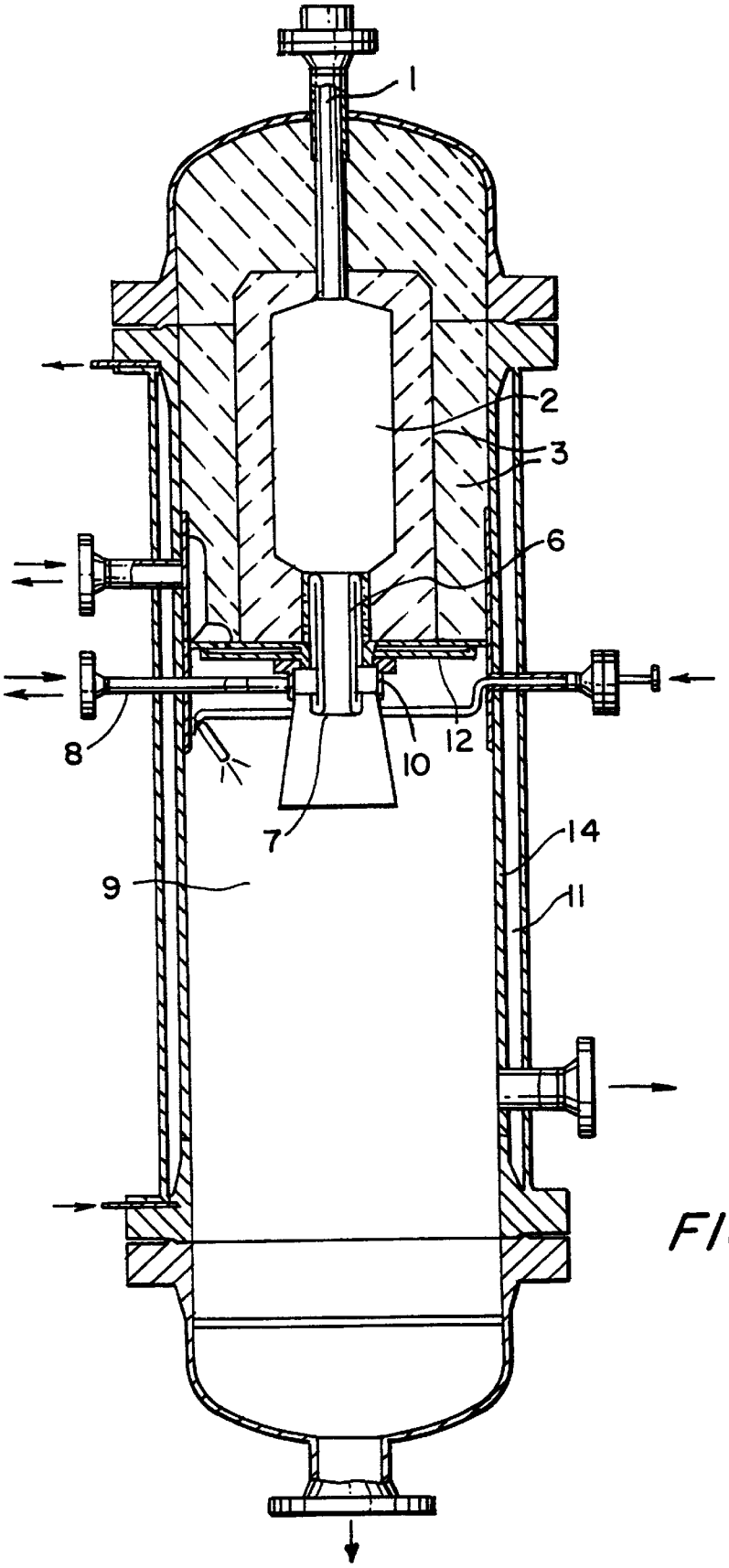
FIG. 2 is a schematic cross-section through an apparatus for the gasification of material with low solid content.

In another embodiment as shown in FIG. 2, the present invention has a reactor for the gasification of materials with low solid content. It is possible in this case for the floor to be made of only refractory-grade material and to have only the outlet opening be cooled.

The refractory-grade lining 3 of the reactor is supported on a cooled carrier plate 12. The outlet cooling means 6 has a tubular design, which ensures high flow speeds of the cooling water. As in FIG. 1, the slag drain edge 7 forms the lower seal of the reaction chamber relative to the cooling and washing stage 9.

Figure 3:
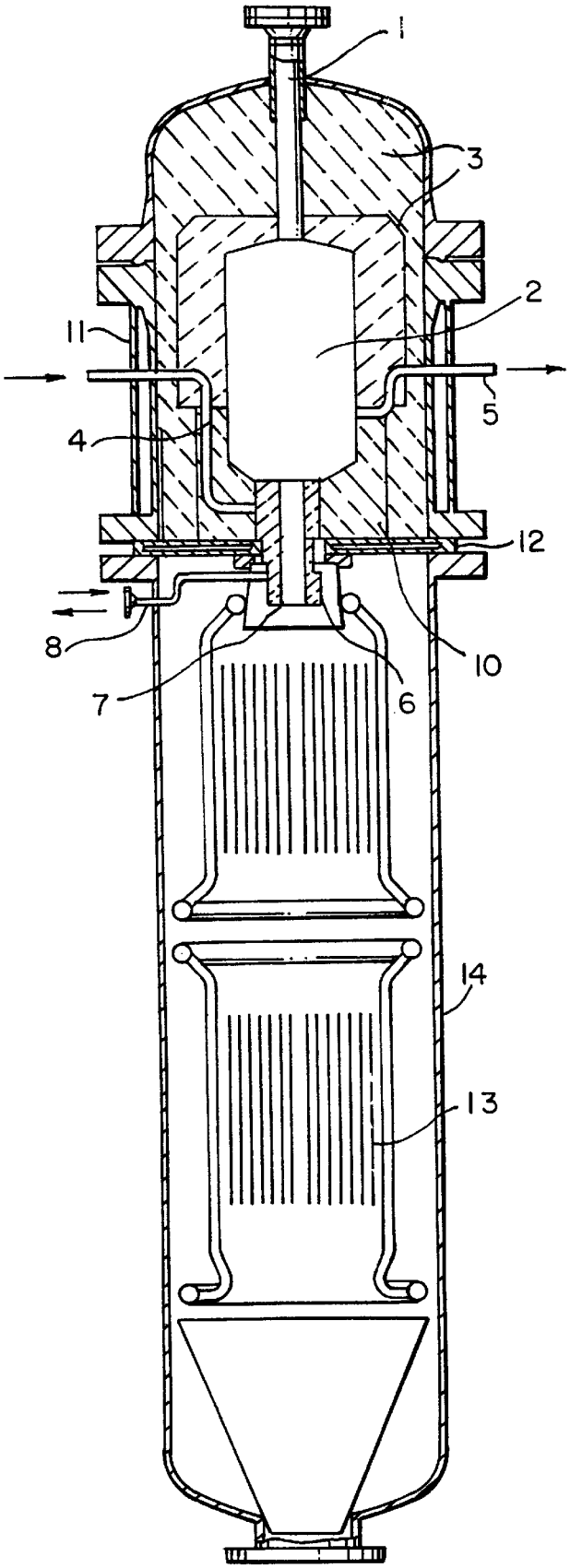
FIG. 3 is a schematic cross-section through an apparatus with a downstream waste-heat boiler.

In a further embodiment as shown in FIG. 3, the present invention has a gasification reactor with a downstream waste-heat boiler 13. Whereas in FIGS. 1 and 2 the sensible heat of the gasification gas leaving the reactor at approximately 1500° C. and that of the molten slag can be bound by the evaporation of water sprayed into the cooling and washing stage 9, here it can be advantageous, with respect to energy and technology, to use this sensible heat to produce high-pressure steam. For this purpose, the reactor types shown in FIGS. 1 and 2 are followed in FIG. 3 by a waste-heat boiler 13 rather than by the cooling and washing stage 9.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A fluidized-bed reactor for gasification of combustion, residual and waste materials containing carbon and ash using an oxygen-containing oxidizing agent at temperatures above the melting point of the inorganic parts of said combustion, residual and waste materials at a pressure between ambient pressure and 60 bar, comprising:

a fluidized-bed reaction chamber;

a refractory-grade lining configured to form a first, upper part of said reaction chamber; and a cooling wall configured to form a second, lower part of said reaction chamber, said cooling wall including cooling coils connected in a gas-tight manner, said cooling coils being coated with a heat-conducting ceramic layer and operated, while being cooled by pressurized water, below or above the boiling point of the cooling water, said refractory-grade lining and said cooling wall being joined in an overlapping fashion so as to compensate for different heat expansions.

2. The fluidized-bed reactor of claim 1, wherein said reactor is operated at a pressure between ambient pressure and 30 bar.

3. The fluidized-bed reactor of claim 1, wherein said cooling wall of said reaction chamber comprises a double-mantle design with a cooling space.

4. The fluidized-bed reactor of claim 1, wherein said second part of said reaction chamber includes a lower floor and a lower outlet opening.

5. The fluidized-bed reactor of claim 4, wherein said cooling wall of said reaction chamber is limited to said lower outlet opening.

6. The fluidized-bed reactor of claim 4, further comprising a cylindrical mantle surrounding said reaction chamber, and cooling means to cool said lower floor and said lower outlet opening of said reaction chamber, said cooling means being connected in series or in parallel with said cylindrical mantle.

7. The fluidized-bed reactor of claim 1, wherein said first part and said second part of said reaction chamber are the upper part and the lower part, respectively, of said reaction chamber.

* * * * *